US006539685B2

(12) United States Patent
Bell et al.

(10) Patent No.: US 6,539,685 B2
(45) Date of Patent: Apr. 1, 2003

(54) APPARATUS AND METHOD FOR LIFTING SUNKEN FOUNDATIONS

(76) Inventors: Thomas A. Bell, 415 Peale St., Joliet, IL (US) 60433; Bill Rietveld, 750 W. Michigan Rd., New Lenox, IL (US) 60451

( * ) Notice: Subject to any disclaimer, the term of this patent is extended or adjusted under 35 U.S.C. 154(b) by 0 days.

(21) Appl. No.: 09/956,813

(22) Filed: Sep. 21, 2001

(65) Prior Publication Data

US 2002/0062622 A1 May 30, 2002

Related U.S. Application Data

(60) Provisional application No. 60/253,099, filed on Nov. 28, 2000.

(51) Int. Cl.[7] ..... E02D 5/00

(52) U.S. Cl. ..... 52/741.15; 52/169.2; 52/169.9; 52/126.7; 52/126.6; 405/230; 405/229; 405/233; 405/239

(58) Field of Search ..... 405/230, 229; 52/126.5, 126.6, 126.7

(56) References Cited

U.S. PATENT DOCUMENTS

| | | | | | |
|---|---|---|---|---|---|
| 2,982,103 | A | | 5/1961 | Revesz et al. | |
| 3,902,326 | A | | 9/1975 | Langenbach, Jr. | |
| 4,673,315 | A | * | 6/1987 | Shaw et al. | 405/229 |
| 4,678,373 | A | * | 7/1987 | Langenbach, Jr. | 405/230 |
| 4,695,203 | A | | 9/1987 | Gregory | |
| 4,708,528 | A | | 11/1987 | Rippe | |
| 4,765,777 | A | | 8/1988 | Gregory | |
| 4,854,782 | A | * | 8/1989 | May | 405/230 |
| 5,013,190 | A | * | 5/1991 | Green | 254/29 R |
| 5,120,163 | A | * | 6/1992 | Holdeman et al. | 405/229 |
| 5,154,539 | A | | 10/1992 | McCown, Sr. et al. | |
| 5,213,448 | A | * | 5/1993 | Seider et al. | 405/229 |
| 5,492,437 | A | | 2/1996 | Ortiz | |
| 5,724,781 | A | | 3/1998 | Matthias et al. | |
| 5,800,094 | A | * | 9/1998 | Jones | 405/230 |
| 6,079,905 | A | * | 6/2000 | Ruiz et al. | 405/229 |
| 6,142,710 | A | * | 11/2000 | Holland et al. | 405/229 |
| 6,352,390 | B1 | * | 3/2002 | Jones | 405/230 |

FOREIGN PATENT DOCUMENTS

| | | |
|---|---|---|
| GB | 325093 | 2/1930 |
| GB | 985351 | 3/1965 |
| GB | 1418164 | 12/1975 |

* cited by examiner

*Primary Examiner*—Carl D. Friedman
*Assistant Examiner*—Basil Katcheves
(74) *Attorney, Agent, or Firm*—Richard C. Litman

(57) ABSTRACT

An apparatus for lifting and stabilizing sunken or settled foundations, slabs, footings, etc. includes a lifting plate having a pipe section solidly secured thereto, for passing concentrically over the anchor pier used in such operations. The concentric lifting plate pipe precludes cocking or tilting of the plate relative to the anchor pier and foundation structure, thereby greatly improving the security of the lifting operation. As a result of the increased lifting plate stability provided by the present invention, only a single clamp is needed for securing the lifting assembly to the foundation. The clamp is adjustably positionable as required, to secure to a solid area of the foundation structure. The present system secures the plate to the pier using mechanical fasteners, thus precluding requirement for costly welding and other metal forming equipment. A method of raising or stabilizing a foundation or similar structure using the present apparatus, is also disclosed.

6 Claims, 3 Drawing Sheets

APPARATUS AND METHOD FOR LIFTING SUNKEN FOUNDATIONS

CROSS-REFERENCE TO RELATED APPLICATION

This application claims the benefit of U.S. Provisional Patent Application Serial No. 60/253,099, filed Nov. 28, 2000.

BACKGROUND OF THE INVENTION

1. Field of the Invention

The present invention relates generally to fixtures, tools, and equipment used in the building construction trades, and more specifically to a system for lifting and/or stabilizing foundations, slabs, and the like, of buildings which have settled after construction. The present system includes a lifting bracket with a pipe section which fits concentrically about an anchor pier driven into the ground adjacent the building structure, and precludes any tilting or slippage of the lifting bracket as it lifts the building structure. The present device may be used with either helical or auger type piers which are turned into the ground for anchoring, with "push" type piers or pilings, which are driven straight into the underlying material, or with virtually any other type of piling or pier which might be developed for such work.

2. Description of Related Art

The slow settling of the foundations of buildings, concrete slabs, and other heavy structures is a phenomenon occurring occasionally in various areas, particularly where the underlying soil is not stable. While engineers endeavor to assure that the underlying surface is stable, and/or to construct the foundation of the structure so that it is resting upon a lower layer of stable material, such structures nevertheless will settle on occasion.

As a result, various equipment and techniques have been developed for lifting sunken or settled foundations, slabs, etc. These techniques generally involve the digging of a hole or trench along the structure to be lifted, and driving one or more pipes or piers into the ground adjacent to the structure until the pipes reach stable material or the underlying bedrock. A lifting apparatus is then installed on the support pier and extended beneath a portion of the structure to be raised, and some means (nearly universally hydraulic) is used to lift the lifting apparatus and structure resting thereon. This process is conducted simultaneously every several feet as needed along the length of the structure being raised, in order to distribute the lifting forces generally equally along the structure.

However, such lifting devices as developed in the past, suffer from various deficiencies which can result in considerable additional time and effort on the part of crews engaged in such operations. For example, many of the devices of the prior art are location beneath the edge of a slab or footing. While most such devices include bolts, pins, etc. to secure the lifting device positively to the structure, these are limited in their attachment location and cannot always provide the security desired. Moreover, many of the prior art devices are subject to tilting or cocking angularly when force is applied, thus creating further risk that the lifting device will slip from beneath the foundation or slab.

Another problem incurred using many of the devices of the prior art, is that many such devices do not provide any form of mechanical locking to secure the lifting element (plate, arm, etc.) to its corresponding anchor pier or pipe. The lifting component is raised by one or more hydraulic jacks, but some means must be provided to secure the lifting component to the pier, before the hydraulic devices can be removed. Such assemblies require additional tools in the form of welding equipment, so the lifting element can be welded to its associated anchor pier. This greatly increases the time required for the lifting operation, as well as increasing the expense due to the necessity of providing and transporting welding equipment to the job site.

Accordingly, a need will be seen for an apparatus and method for lifting sunken or settled building foundations, footings, slabs, etc., which provide much more positive support of the overlying building structure than has been the case with devices of the prior art. The present lifting apparatus overcomes this problem by means of a concentric pipe sleeve which passes around the pipe of the anchor pier, thereby precluding any tilting or cocking of the lifting plate. The present device also secures positively to the building structure, with the attachment being adjustably positionable to provide selective attachment to a solid area of the structure.

A discussion of the related art of which the present inventors are aware, and its differences and distinctions from the present invention, is provided below.

U.S. Pat. No. 2,982,103 issued on May 2, 1961 to Guy H. Revesz et al., titled "Method And Apparatus For Underpinning A Building," describes a system with a generally vertically disposed plate which bolts to the wall of the structure being lifted. The Revesz et al. disclosure primarily describes a method of setting the anchor pier into a solid underlying substrate, using the lifting plate bolted to the structure wall and other components. Revesz et al. do not provide any means of supporting the structure from beneath nor of securing the lifting plate directly to the anchor pier, as is done with the present invention. Also, the Revesz et al. lifting plate has four holes in a predetermined pattern. If bolts passing through these holes do not happen to secure to solid material, the entire apparatus must be relocated to an area of solid structural material for secure attachment thereto.

U.S. Pat. No. 3,902,326 issued on Sep. 2, 1975 to George F. Langenbach Jr., titled "Apparatus And Method For Shoring A Foundation," describes a system wherein a guide pipe has an elongate hydraulic cylinder installed concentrically therein. The cylinder is secured to a generally C-shaped bracket, which in turn grips one edge of a foundation or footing. The bracket includes a section of pipe which passes around the anchor piling or pier, and is locked thereto by a radially disposed bolt when the lifting operation is complete. However, the Langenbach, Jr. assembly has no provision for attaching the lifting device to the side of the wall, as provided by the present invention, and does not use an externally disposed jack, as is the case with the present system.

U.S. Pat. No. 4,673,315 issued on Jun. 16, 1987 to Robert R. Shaw et al., titled "Apparatus For Raising And Supporting A Building," describes a lifting plate including a pipe section which fits around the anchor pipe or pier which is driven into the ground. The plate includes laterally opposed ears or lugs, to which the ends of a pair of hydraulic jacks are secured. The upper ends of the jacks are secured to lugs extending from an adjustably positionable collar on the anchor pier. The jacks are actuated to drive the pier into the ground and eventually raise the structure, when the pier encounters sufficient resistance. However, Shaw et al. fail to provide any means of locking the lifting plate to the anchor pier, other than by welding. Thus, they require welding and metal cutting equipment to secure the lifting plate to the pier, and to remove the section of pipe or pier above the lifting plate. Moreover, Shaw et al. do not provide any means of securing the plate positively to the wall of the structure being lifted.

U.S. Pat. No. 4,695,203 issued on Sep. 22, 1987 to Steven D. Gregory, titled "Method And Apparatus For Shoring And Supporting A Building Foundation," describes a system functioning similarly to that of the Shaw et al. system described above, but utilizing only a single hydraulic jack centered atop the pier and lifting an inverted saddle, which in turn attaches to the lifting plate or arm by means of a pair of lugs extending therefrom. Again, no mechanical means is provided for securing the lifting plate to the pier pipe. Welding equipment must be provided to weld the assembly together, to allow the hydraulics to be removed.

U.S. Pat. No. 4,708,528 issued on Nov. 24, 1987 to Dondeville M. Rippe, titled "Process And Apparatus For Stabilizing Foundations," describes a system more closely related to the system described further above in the '326 U.S. patent to Langenbach, Jr., than to the present invention. Rippe provides a single hydraulic jack which lifts a concentrically placed lifting apparatus above the jack. The lifting apparatus is in turn attached to a concentric lifting cylinder which has a single pin which inserts into a hole formed in the wall of the structure. Thus, the Rippe apparatus does not lift the structure from below, as in the present invention, but relies upon a single pin inserted into a hole in the wall of the structure. The very small bearing cross sectional area provided by the hole in the wall, results in severe limitations insofar as the load which may be supported.

U.S. Pat. No. 4,765,777 issued on Aug. 23, 1988 to Steven D. Gregory, titled "Apparatus And Method For Raising And Supporting A Building," describes an apparatus more closely related to those of the '315 and '203 U.S. patents respectively to Shaw et al. and Gregory, described further above, than to the present invention. The '777 Gregory device includes a pair of opposed hydraulic lifting cylinders, which secure to a collar about the upper end of the anchor pier or pipe. The lower ends of the cylinders secure to the lifting bracket. However, the lifting bracket does not have a pipe passing concentrically about the anchor pier, and thus is not as securely held in place as the lifting bracket of the present invention.

U.S. Pat. No. 5,154,539 issued on Oct. 13, 1992 to William B. McCown, Sr. et al., titled "Foundation Lifting And Stabilizing Apparatus," describes an assembly somewhat related to that of the Gregory '203 U.S. patent described further above. The McCown, Sr. et al. system utilizes a specialized collar disposed above the anchor pier, with a single concentric hydraulic jack attaching to the top of the collar and bearing downwardly against the top of the pier. The jack and collar assembly are retained by a pair of lifting bars which secure to lugs on the collar and to lugs extending from the lifting arm extending beneath the structure being lifted. However, the McCown, Sr. et al. lifting arm does not positively secure to the building structure.

U.S. Pat. No. 5,213,448 issued on May 25, 1993 to Gary L. Seider et al., titled "Underpinning Bracket For Uplift And Settlement Loading," describes a system utilizing a screw anchor, rather than a pipe pier, for support. Such screw anchors do not provide the bending resistance of a pipe of equal weight, as the columnar strength of a screw anchor is concentrated along its center, rather than being distributed in its walls as in the case of a pipe. Seider et al. respond to this problem by bolting their lifting bracket to the foundation or wall using a plurality of bolts, in an effort to preclude any angular movement of the bracket relative to the wall. However, they do not provide the resistance to relative angular motion between the lifting bracket and its support which is provided by the present invention, due to the open channel of the lifting bracket.

U.S. Pat. No. 5,492,437 issued on Feb. 20, 1996 to Leo P. Ortiz, titled "Self-Aligning Devices And Methods For Lifting And Securing Structures," describes a system more closely related to that of the '315 and '777 U.S. patents respectively to Shaw and Gregory, discussed further above, than to the present invention. Ortiz uses two opposed hydraulic cylinders, but secures them to a pivot at the top of the anchor pier in order to compensate for slight irregularities in the forces involved. Otherwise, the Ortiz device is quite similar to other systems utilizing two opposed hydraulic cylinders. The Ortiz assembly cannot be progressively secured in place, as provided by the present invention. Rather, holes are drilled into the anchor pier through existing holes formed in the surrounding pipe of the lifting bracket, and the lifting bracket is bolted in place at the end of the operation.

U.S. Pat. No. 5,724,781 issued on Mar. 10, 1998 to Billie H. Matthias et al., titled "Method For Raising Foundations," describes an apparatus more closely resembling that of the Gregory '203 U.S. patent discussed further above, than the present system. Matthias et al. place a hydraulic cylinder atop the pier and use it to lift an inverted saddle extending across the top of the lifting cylinder, to lift the lifting bracket by ears or lugs extending therefrom. While FIGS. 4 and 5 of Matthias et al. appear to show threaded lifting rods, they are not described as such, and in any event, no disclosure is made of stop nuts beneath the plate to hold the assembly at some intermediate position, nor is any provision made for positively securing the lifting bracket to the structure.

British Patent Publication No. 325,093 accepted on Feb. 13, 1930 to Julian A. Formunt, titled "Improvements Relating To The Provision Of Substructures, Particularly For Subaqueous Work," describes a system for supporting a structure constructed on the bottom of a body of water, as in a bridge pier or the like. A caisson is placed adjacent the base of the structure and into the underlying substrate. The material underlying the structure is then removed and the caisson is moved progressively laterally into position beneath the structure, with pilings or other supports being progressively removed and replaced as required for movement of the caisson. The Formunt system does not provide any means for lifting the overlying structure, but only for supporting it by installing a series of pilings, with the caisson being required during the operation.

British Patent Publication No. 985,351 published on Mar. 10, 1965 to Ludwig Muller, titled "Method Of And Means For Underpinning A Building," describes a system wherein pairs of hydraulic rams are placed beneath a structure, with a girder extending thereacross. The rams are actuated to drive the girder downwardly, whereupon it presses a piling into the substrate. A column is constructed atop the driven piling to support the overlying building structure, once the girder has been removed. The Muller system is relatively more cumbersome than the present building lifting system, in that it requires the extra step of constructing a column atop the piling, once it has been driven.

Finally, British Patent Publication No. 1,418,164 published on Dec. 17, 1975 to Pynford Limited, titled "Improvements In Under-Pinning," describes a system wherein a series of relatively small diameter piers is sunk into the ground adjacent or beneath the edge of the structure to be lifted. A concrete cap is then poured around the upper ends of the pier cluster, to support the overlying building structure. In one embodiment, a plate is bolted to the side of a foundation support beam during the operation; no underlying support plate is provided. In any event, the plate is removed after the concrete support pad has been poured and cured.

None of the above inventions and patents, taken either singly or in combination, is seen to describe the instant invention as claimed.

SUMMARY OF THE INVENTION

An apparatus for lifting sunken or settled foundations, footings, and other base structures of buildings and the like, includes a lifting plate which is welded or otherwise solidly attached to a section of pipe which passes through a hole in the plate. The pipe in turn fits concentrically around the anchor pier or pipe, which is driven into the underlying surface. The pipe section of the anchor plate precludes the cocking or misalignment of the lifting plate as it is being raised, thus providing a much more secure operation, with only a single foundation attachment fitting being required.

The foundation attachment fitting generally comprises a separate clamp which passes around the pipe section of the lifting plate. This clamp may be placed adjustably at any point along the length of the lifting plate pipe, thus allowing the worker to adjust the position of the attachment of the clamp to the foundation structure as required in order to provide solid attachment points for the clamp. No other attachment is required for the lifting plate to the foundation structure.

The present invention also includes a method of lifting a sunken or settled building structure or the like, in which at least one anchor pier is driven into the underlying surface, the lifting plate is placed thereon by sliding the pipe fitting of the plate over the anchor pier pipe, and the lifting plate to foundation attachment clamp is secured to the foundation at a selected solid area of the foundation. A single portable hydraulic jack (e. g., bottle jack) is placed atop a plate on the anchor pier to lift an overlying crossmember which is in turn attached to the lifting plate by an opposed pair of threaded lifting or tension members. After the foundation has been raised as required, the anchor pier plate is immovably secured to the lifting plate by the laterally opposed tension members, and the overlying crossmember and hydraulic jack are removed. The present apparatus and method provide an extremely secure means of lifting and/or stabilizing sunken or settled foundation areas, without the additional labor required to set a series of attachment bolts and the expense involved in multiple lifting jacks or rams. The present foundation lifting apparatus may be used with virtually any type of piling or pier desired, e.g., helical piers using the auger principle, push type piers, etc., as desired.

Accordingly, it is a principal object of the invention to provide an apparatus for lifting and/or stabilizing sunken or settled foundations, footings, and the like, of building structures, which apparatus includes a lifting plate having a pipe section solidly attached thereto, with the pipe section passing around the anchor pier for precluding cocking or tilting of the lifting plate relative to the foundation structure during the lifting operation.

It is another object of the invention to provide an apparatus for lifting sunken foundations including a single clamp to secure the lifting plate to the foundation, the clamp being selectively positionable by a worker for placement at a location on the foundation which provides a solid attachment point for the clamp.

It is a further object of the invention to provide an apparatus for lifting sunken foundations which secures the lifting plate in position on the anchor pier by mechanical means, precluding any further requirement for welding or other metal working or forming equipment.

Still another object of the invention is to provide a method of lifting the sunken or settled foundation of a building structure, utilizing the above described apparatus.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises an apparatus and method, or system, for raising and/or stabilizing settled or sunken building structures. The present system provides a much needed improvement over such systems and devices used in the past, by providing a stable axis for the lifting bracket to ensure that it cannot tilt or cock at an angle during the lifting operation. The present system also provides a novel structural attachment bracket which may be adjustably positioned to secure to the wall, foundation, slab, footing, etc. of the building structure, to ensure that the attachment bracket and its corresponding lifting bracket are solidly secured to sound material to preclude the attachment bracket pulling loose from its attachment.

Figure 1:
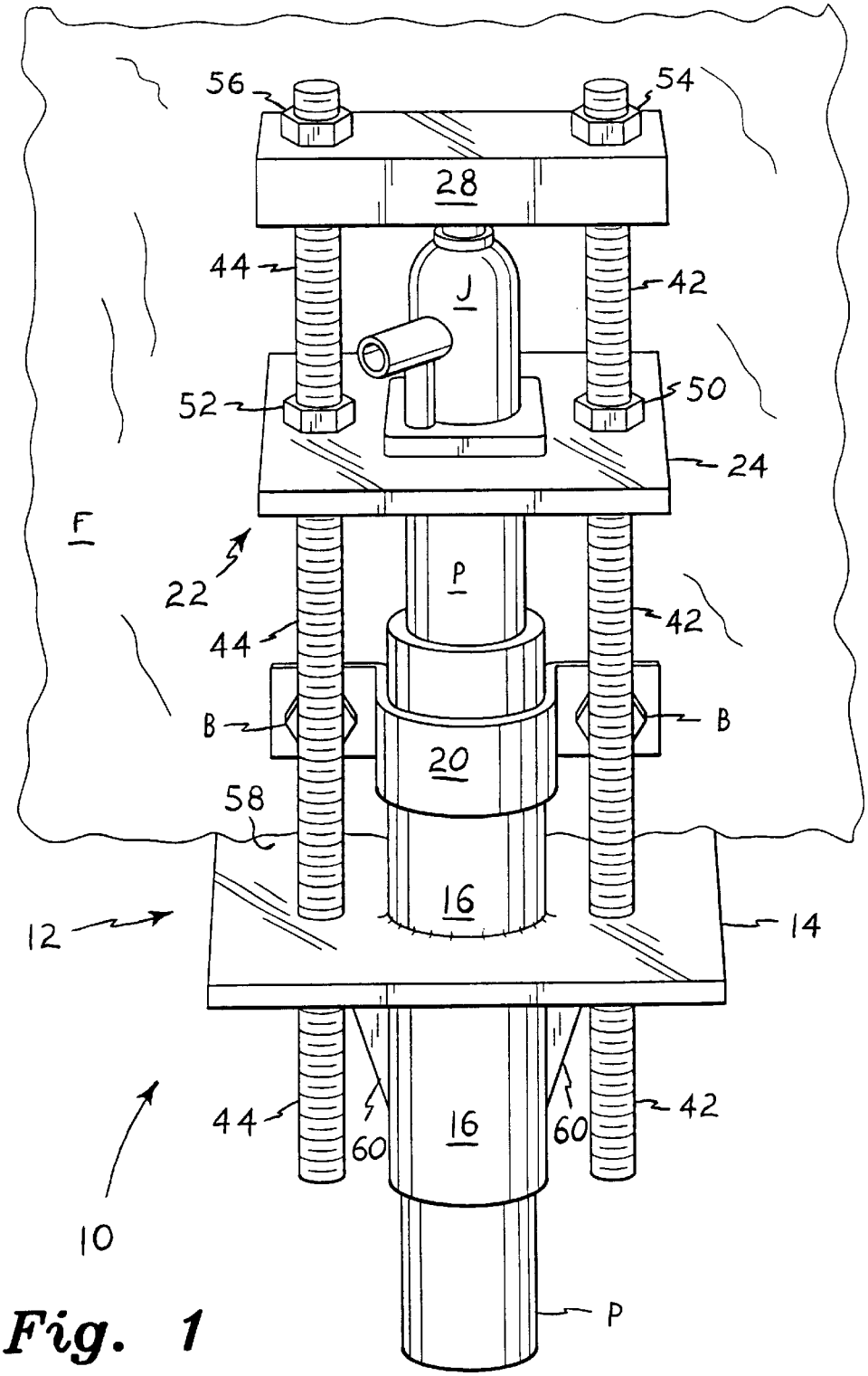
FIG. 1 is an environmental, perspective view of an apparatus for lifting and/or stabilizing sunken foundations according to the present invention, showing its installation to a foundation and anchor pier.

FIG. 1 provides an environmental perspective view of the present apparatus 10, secured in place for lifting the foundation F of a building structure. (It will be understood that while only a single assembly is shown throughout the drawing Figures, it is likely that several such assemblies would be required at spaced intervals along the footing or other area of the building structure to be raised.) The apparatus 10 essentially comprises a lifting bracket 12, which includes a lifting plate 14 with a guide pipe 16 inserted through a passage 18 (FIG. 3) in the lifting plate 14 and solidly affixed (welded, etc.) normal to the plate 14. The guide pipe passage 18 is asymmetrically disposed through the plate 14 to place the guide pipe 16 closer to one side of the plate 14 than the other to provide a lifting flange or extension to one side of the plate 14, as will be appreciated in a comparison of the opposite orientations of FIGS. 1 and 2 of the drawings.

The guide pipe 16 has an interior diameter dimensioned to fit closely about the outer diameter of the conventional anchor pier or pipe P (helical or auger pier or piling, straight push-type piling, etc.), which is driven into the ground generally vertically to a depth sufficient to preclude further settling when the weight of the building is supported thereby; such setting of an anchor pier P is known conventionally in the art. The guide pipe 16 completely surrounding the anchor pier P, assures that the lifting plate 14 cannot tilt or cock angularly relative to the anchor pier P, thus assuring that the plane of the lifting plate 14 is perpendicular to the anchor pier P to extend generally horizontally beneath the foundation or footing F of the structure.

While the anchor pier or pipe P is of a sufficient diameter and wall thickness to preclude any significant bending or flexing, it is preferred that the lifting bracket 12 be positively secured to the foundation structure F in some manner, for greater security in the lifting operation. The present invention accomplishes this by means of an adjustably positionable building structure attachment bracket 20, which is a separate component from the lifting bracket 12 and which may be adjustably positioned as desired. The attachment bracket 20 essentially comprises a semicircular or generally U-shaped central portion, with a flange, lug, or ear extending from each side or end thereof. The central portion is placed around the guide pipe portion 16 of the lifting bracket 12, and securely bolted to the foundation structure F by means of the two opposed lugs extending therefrom, as shown in FIG. 1 of the drawings.

The separate, adjustably positionable foundation attachment bracket 20 provides significant advantages over other foundation attachment means used in the past in the art. By providing an attachment bracket 20 which is separate from the lifting bracket 12 until it is clamped about the guide pipe 16, the attachment bracket 20 may be positioned as desired vertically along the upper portion of the guide pipe 16 to take advantage of more solid areas of the foundation structure F. Other attachment means of the prior art sometimes require that the entire apparatus, including the anchor pier, be moved due to the lack of adjustment for the position of the attachment means when an unsound foundation area is encountered.

Figure 2:
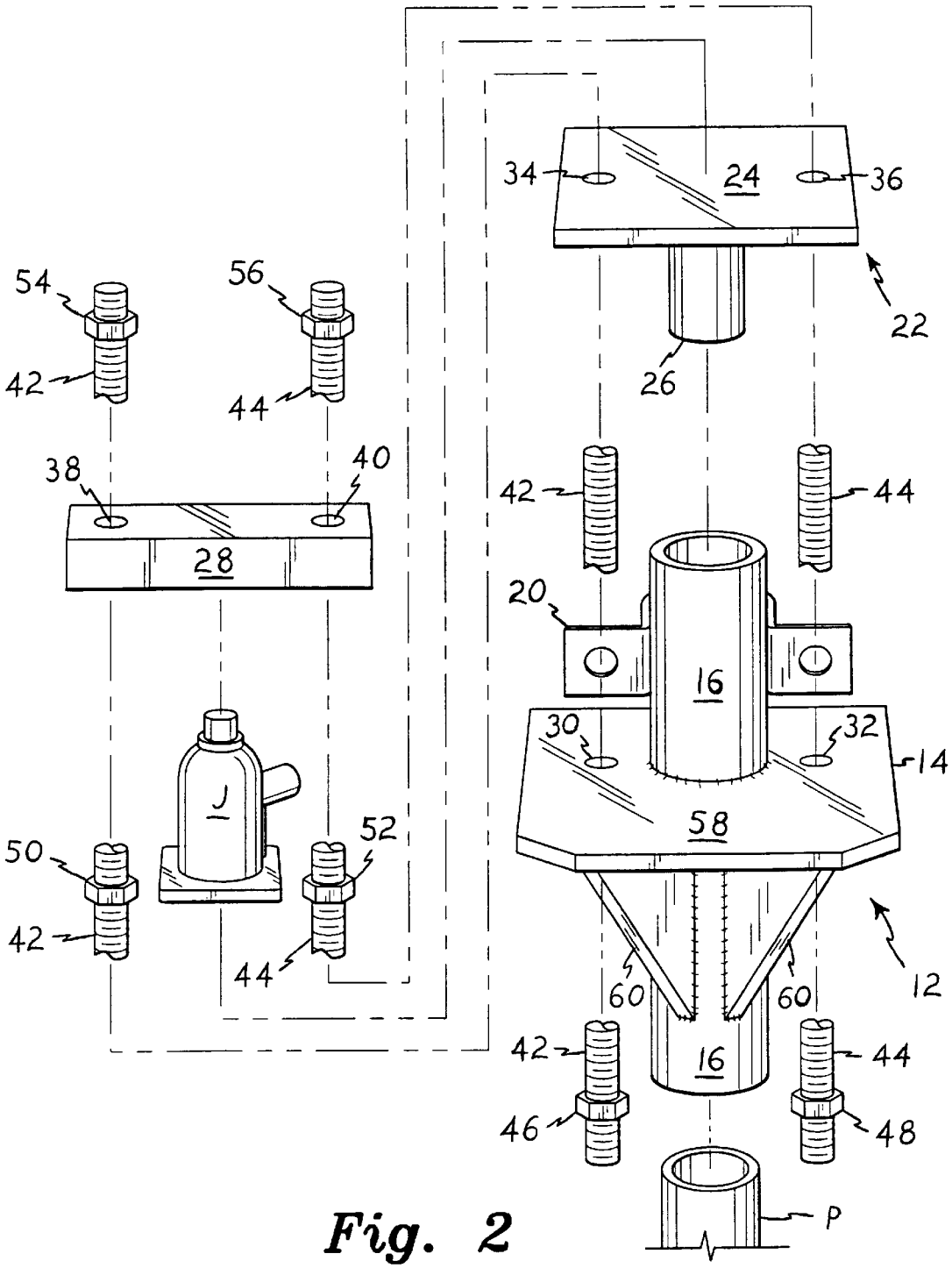
FIG. 2 is an exploded perspective view of the present apparatus from the opposite side shown in FIG. 1, showing further details thereof.
Figure 3:
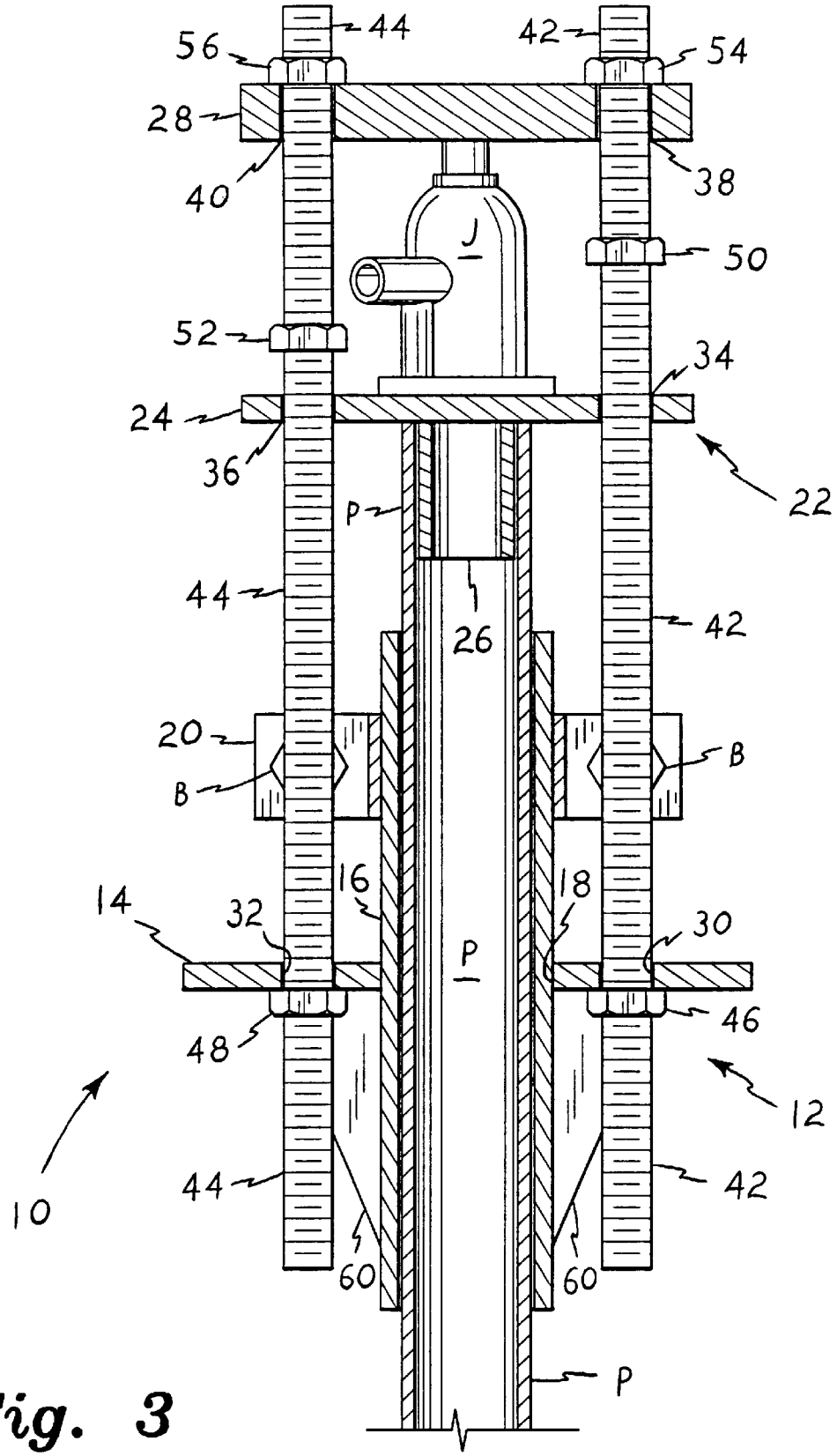
FIG. 3 is an elevation view in section of the present apparatus in an assembled state, showing the interrelationship of the various parts and components thereof.

A jack support bracket 22 is provided for removably installing atop the upper end of the anchor pier pipe P. This jack support bracket 22 provides a secure seat for a portable hydraulic jack J (e. g., bottle jack or the like) which is placed atop the anchor pier P. The jack support bracket 22 essentially comprises a solid, unbroken jack support plate 24 with an anchor pier engagement pipe 26 depending generally concentrically therefrom, as shown in FIGS. 2 and 3 of the drawings. The anchor pier engagement pipe 26 has an outer diameter selected to fit closely within the inner diameter of the anchor pier or pipe P, thus assuring that the jack support bracket 22 cannot move or slip relative to the anchor pier P when the engagement pipe 26 is installed concentrically therein. A lifting bar 28 is placed across the top of the jack J, for the jack J to bear against as it is raised. The jack J is thus captured between the lower jack support bracket 22 and the lifting bar 28 when the present apparatus is assembled. The lifting bar 28 lifts the lifting bracket 12 relative to the anchor pier P to lift the foundation F, as explained further below.

Each of the plates or bars of the present assembly 10 includes a pair of opposed lifting rod passages or holes therethrough, with each set of holes being concentric with their corresponding holes. The lifting plate 14 includes first and second lifting rod passages or holes, respectively 30 and 32 disposed to each side of the guide pipe or sleeve 16, as shown in FIGS. 2 and 3. The jack support plate 24 and lifting bar 28 each have corresponding passages, respectively 34 and 36 for the plate 24 and 38, 40 for the bar 28.

A pair of threaded lifting rods, respectively 42 and 44, passes through the respective plate and bar passages, with the first rod 42 extending through the first passages 30, 34, and 38, and the second rod 44 passing through the second passages 32, 36, and 40. First and second nuts 46, 48 secure the lower ends of the rods 42 and 44 beneath the lifting plate 14, with a pair of height adjustment lock nuts 50, 52 installed between the jack support plate 24 and the lifting bar 28 and a second pair of nuts 54, 56 placed on the upper ends of the respective tension rods 42 and 44 atop the lifting bar 28. These two rods 42 and 44 secure the assembly 10 together and provide the required tensile connection between the lower lifting bracket 12 and the upper lifting bar 28.

The present foundation lifting system 10 is used by first digging a hole immediately adjacent the foundation F, with the hole extending at least slightly below the bottom of the foundation or footing F. The anchor pier or pipe P is then driven downwardly in the hole immediately adjacent the foundation F until reaching a solid underlying stratum, as is conventional in the art of raising sunken or settled building structures. In most cases, it will be necessary to provide a series of spaced apart holes every several feet along the length of the structure foundation, and to drive a corresponding number of piers, in order to provide the uniform lifting along the entire settled portion of the structure. It will be seen that while the present description discusses only a single installation, it is applicable to such multiple installations by extension of the procedure.

If the lifting bracket 12 has not previously been placed upon the anchor pier P before driving the anchor pier, it may be installed on the anchor pier P at this time, by sliding the guide pipe 16 over the top of the anchor pier P and dropping the lifting bracket 12 downwardly. It will be seen that the longer, extended side 58 of the lifting plate 14 must be turned away from the foundation structure F during this operation, as it will not clear. However, the hole alongside the foundation structure F is dug out somewhat below the bottom portion of the foundation structure, which may provide clearance to pivot the anchor bracket 12 around to extend the plate extension side 58 beneath the foundation F. If clearance between the anchor pier P and the foundation structure F will be so tight that the lifting bracket 12 will not clear the foundation structure F regardless of orientation, then the bracket 12 must be installed upon the anchor pier P before the pier P is immovably set into the underlying surface.

Once the bracket 12 has been installed upon the anchor pier P and positioned with the extension side 58 of the lifting plate 14 extending beneath the foundation structure F, the assembly 10 may be further secured to the foundation F by means of the foundation attachment bracket 20. The attachment bracket 20 is placed around the upper portion of the guide pipe 16, and expansion bolts B or other suitable attachment means are driven into the foundation F to secure the attachment bracket 20, and thus the lifting bracket 12, thereto.

As the attachment bracket 20 is not a permanently attached component of the lifting bracket 12, it may be selectively positioned as desired along the guide pipe 16 to place the attachment lugs or ears adjacent a location of solid material on the foundation F. Oftentimes, the foundation, footing, etc. of a building structure will deteriorate over a long period of time, with certain areas of the foundation not having the original structural strength. Such deteriorated areas generally cannot be detected until after the hole has been dug for the lifting equipment. With conventional building lifting systems, the foundation attachment points are fixed relative to the lifting assembly, and if the attachment bolts are found to be located at an area of the foundation which is relatively weak, whereupon the attachment bolts would pull out during the lifting operation, then the entire lifting assembly and anchor pier must be relocated laterally to a location where the foundation structure is strong.

The present invention does not require such complete relocation in the event of a locally weakened foundation structure. All that is necessary, is for the height of the foundation attachment bracket 20 to be raised or lowered along the guide pipe 16, while all other components of the assembly 10 remain in place. This greatly facilitates the installation and lifting operations using the present invention, and saves considerable time, labor, and expense whenever a deteriorated area of a foundation is encountered.

After the lifting bracket 12 has been positioned with the extension side 58 of the lifting plate 14 extending beneath the foundation F and the foundation attachment bracket 20 secured to the foundation F, generally as shown in FIG. 1, the jack support bracket 22 is installed upon the upper end of the anchor pier P by placing the anchor pier engagement pipe 26 into the upper end of the pier P, as shown in FIGS. 2 and 3 of the drawings. The lifting rod holes 30 and 32 of the jack support plate 24 are aligned with the corresponding holes 30 and 32 of the lifting plate 14, by rotating the jack support bracket 22 as required about its pipe 26 placed in the upper end of the anchor pier P.

The two threaded lifting rods 42 and 44 may then be installed through the respective rod passages 30, 34 (for the first rod 42) and 32, 36 (for the second rod 44) of the lifting plate 14 and jack support plate 24. Cooperating intermediate nuts 50 and 52 are threaded down the respective lifting rods 42 and 44 to rest atop the jack support plate 24, to prevent the two rods 42, 44 from dropping further downwardly through their respective passages. The exact positioning of these two intermediate nuts 50, 52 is not critical at this point. Preferably, they are positioned along their respective lifting rods 42, 44 so as to leave some short extension length (e. g., an inch or so) of rod extending below the bottom of the lifting plate 14. The precise length of rod extending below the plate 14 is not critical, so long as there is sufficient length to secure the two lower nuts 46 and 48 beneath the lifting plate 14.

At this point, the retracted lifting jack J is placed atop the jack support bracket 22, and the lifting bar 28 is installed atop the jack J by passing the two lift bar passages 38, 40 over the corresponding lifting rods 42, 44 and securing the lift bar 28 in place using the two uppermost nuts 54 and 56. The lifting jack J is thus captured between the two members 24 and 28, and will spread those two components 24 and 28 apart as the lifting jack J is operated conventionally to extend its lift cylinder.

This action will also raise the lifting bracket 12 relative to the anchor pier P, due to the interconnection between the lifting bracket 12 and lift bar 28 provided by the two lifting rods 42 and 44. The base of the jack J is at a fixed level relative to the anchor pier P, as it is resting atop the jack support bracket 22, which is in turn resting atop the anchor pier P. Thus, actuating the jack J lifts the lifting bar 28 relative to the anchor pier P, and also the lifting bracket 12 due to its connection to the lifting bar 28 by means of the lifting rods 42, 44. This raises the foundation F incrementally as the jack J is actuated, due to the lifting plate extension 58 extending beneath the foundation F. (The extension 58 is preferably reinforced with one or more support gussets 60, which form webs between the guide pipe 16 and lifting plate 14.) As the guide pipe 16 is coaxial with the generally vertically aligned anchor pier P, the lifting plate 14 normal to the guide pipe 16 will remain generally horizontal, or at least at right angles to the anchor pier P throughout the lifting operation.

The jacking and lifting process is continued as required, perhaps being alternately spread among several essentially identical installations along the length of the building foundation. If the extension limit of the jack J is approached while still further lifting is required, then the two intermediate nuts 50 and 52 may be threaded down to rest atop the jack support plate 24. It will be seen that this locks the height of the lift bracket 12, and foundation structure F resting thereon, as the lift rods 42 and 44 cannot descend through the jack support plate 24 when the two intermediate nuts 50, 52 are bearing against the top of the jack support plate 24. This allows the jack J to be retracted, the height of the lifting bar 28 lowered to rest upon the retracted jack J, and the upper nuts 54 and 56 threaded downwardly to hold the lifting bar in position against the top of the jack J, whereupon the lifting operation may be continued.

While the two lifting rods 42, 44 are each illustrated as single lengths of threaded rod, it will be seen that they may be formed of multiple lengths, if required. Conventional couplings (not shown) may be used to secure two or more rods together as required, depending upon the depth of the hole and foundation structure and the amount of lift required to restore the structure to the desired level. These couplings may be installed at any convenient location(s) along the length of the rods, so long as they provide sufficient length for clearance from the overlying jack support plate 24 and/or lifting bar 28 throughout the entire lifting operation.

Once the foundation F has been lifted to the required level, the intermediate height locking nuts 50 and 52 are again threaded downwardly to bear against the underlying jack support plate 24. This assures that the height adjustment will remain fixed as pressure is relieved on the jack J. Once pressure has been relieved on the jack J, it may be removed from its operating position between the jack support plate 24 and the overlying lifting bar 28, for later reuse. The two upper nuts 54 and 56 may then be removed from their respective lift rods 42 and 44 and the lifting bar 28 removed from the rods, for later reuse of the lifting bar 28. the upper ends of the two rods 42 and 44, i. e., the portions extending above the nuts 50 and 52 immediately above the jack support bracket 22, may be cut off as required if they would otherwise extend above grade once the excavation has been filled in.

In conclusion, the present apparatus and method for lifting, leveling, and stabilizing sunken building foundations and similar structures, provides a significant improvement in economy over earlier systems of the prior art. No complex tools are required in the field for the assembly and operation of the present system, as the adjustments require only hand wrenches and similar tools. The only power tool which might be desirable would be a power cutoff tool of some sort, in the event that it is wished to cut off the upper ends of the two lifting rods at or below grade. It will be seen that this is not an absolute requirement, however, and this may be avoided by predetermining the rod lengths required.

The only components of the present system 10 which remain permanently installed at the building foundation F, are the anchor pier P (required of any foundation leveling and support system), the lifting bracket 12 secured thereto, the foundation attachment bracket or collar 20, the jack support bracket 22, and the two lifting rods 42 and 44 and their associated nuts 46, 48, 50, and 52. The more costly component, i. e. the hydraulic jack J, as well as the lifting bar 28, are removed once the lifting operation has been completed. The lack of requirement for any expensive and complex welding or other power equipment, also greatly simplifies the use of the present lifting system. The result is a significant savings of money in terms of single use equipment and components, and a further significant savings in labor and therefore cost due to the ease of use of the present system, which results in greater profits for the user and economies for the consumer.

It is to be understood that the present invention is not limited to the embodiments described above, but encompasses any and all embodiments within the scope of the following claims.

We claim:

1. An apparatus using anchor piers for lifting and stabilizing sunken and settled foundations, slabs, and footings of building structures, comprising:

a lifting bracket having:

a lifting plate for installing beneath a sunken building structure, said lifting plate having a guide pipe passage formed asymmetrically therethrough;

a guide pipe solidly affixed through said guide pipe passage of said lifting plate and normal thereto, for passing concentrically about an anchor pier and retaining said lifting plate normal relative to the anchor pier and precluding cocking and tilting of said lifting plate relative to the anchor pier; and an adjustably positionable building structure attachment bracket selectively positioned about the guide pipe of said lifting bracket for securing said lifting bracket to a selected solid portion of the building structure, said structure attachment bracket including a semicircular central portion with a flange extending from each side thereof.

2. The apparatus according to claim 1, further including:

a first and a second lifting rod passage formed through said lifting plate, with one said lifting rod passage disposed to each side of said guide pipe.

3. The apparatus according to claim 1, further including:

a jack support bracket, for removably installing atop the anchor support pier for removably placing a lifting jack thereon;

said jack support bracket comprising a jack support plate with an anchor pier engagement pipe depending therefrom, for removably inserting concentrically within an upper end of the anchor pier; and a lifting bar removably installed above said jack support plate, for capturing the lifting jack therebetween.

4. The apparatus according to claim 3, further including:

a first and a second lifting rod passage formed through said lifting plate, with one said lifting rod passage disposed to each side of said guide pipe; and a first and a second lifting rod passage formed through said jack support bracket and said lifting bar, with each said lifting rod passage being aligned with the corresponding said lifting rod passage of said lifting plate.

5. The apparatus according to claim 4, further including:

first and second threaded lifting rods, removably and adjustably installed respectively through said first and said second lifting rod passages of said lifting plate, said jack support plate, and said lifting bar, for lifting said lifting plate when the lifting jack is actuated to lift said lifting bar relative to said jack support plate.

6. The apparatus according to claim 1, further including:

at least one support gusset disposed beneath said lifting plate, between said guide pipe and said lifting plate.

* * * * *